US011074903B1

(12) United States Patent
Yen et al.

(10) Patent No.: US 11,074,903 B1
(45) Date of Patent: Jul. 27, 2021

(54) AUDIO DEVICE WITH ADAPTIVE EQUALIZATION

(71) Applicant: Amazon Technologies, Inc., Seattle, WA (US)

(72) Inventors: Kuan-Chieh Yen, Foster City, CA (US); Ali Abdollahzadeh Milani, Sunnyvale, CA (US)

(73) Assignee: Amazon Technologies, Inc., Seattle, WA (US)

( * ) Notice: Subject to any disclaimer, the term of this patent is extended or adjusted under 35 U.S.C. 154(b) by 0 days.

(21) Appl. No.: 16/834,487

(22) Filed: Mar. 30, 2020

(51) Int. Cl.
*G10K 11/178* (2006.01)
*H04R 1/10* (2006.01)

(52) U.S. Cl.
CPC ..... *G10K 11/17854* (2018.01); *H04R 1/1016* (2013.01); *G10K 2210/1081* (2013.01); *H04R 1/1083* (2013.01)

(58) Field of Classification Search
CPC ..... G10K 11/17854; G10K 2210/1081; G10K 2210/3014; H04R 1/1016; H04R 1/1083
USPC ..... 381/71.6, 71.11, 71.12, 72, 74, 317, 328
See application file for complete search history.

(56) References Cited

U.S. PATENT DOCUMENTS

| | | | | |
|---|---|---|---|---|
| 6,418,228 | B1 * | 7/2002 | Terai | G10K 11/17881 381/71.8 |
| 8,116,472 | B2 * | 2/2012 | Mizuno | G10K 11/17854 381/71.1 |
| 9,082,389 | B2 * | 7/2015 | Nicholson | G10K 11/17854 |
| 9,478,212 | B1 * | 10/2016 | Sorensen | G10K 11/17817 |
| 9,648,410 | B1 * | 5/2017 | Kratsas | G10K 11/17881 |
| 9,807,503 | B1 * | 10/2017 | Sorensen | G10K 11/17885 |
| 10,026,388 | B2 * | 7/2018 | Lu | G10K 11/17815 |
| 10,878,796 | B2 * | 12/2020 | Zhao | G10K 11/17853 |
| 2013/0136271 | A1 * | 5/2013 | Buck | G10K 11/002 381/71.11 |
| 2015/0092953 | A1 * | 4/2015 | Abdollahzadeh Milani | G10K 11/17881 381/71.6 |
| 2016/0232887 | A1 * | 8/2016 | Hendrix | G10K 11/17881 |

* cited by examiner

*Primary Examiner* — Xu Mei
(74) *Attorney, Agent, or Firm* — Pierce Atwood LLP

(57) ABSTRACT

A system and method includes an audio device, such as an earbud or headphones, that includes one or more loudspeakers for outputting audio. The audio device further in includes one or more microphones that are positioned near an ear of a user. An acoustic barrier may be formed between a surface of the device and the ear of the user; properties of this barrier may, however, vary from user to user. The system determines these properties on a per-user basis and compensates for any differences therein.

20 Claims, 7 Drawing Sheets

AUDIO DEVICE WITH ADAPTIVE EQUALIZATION

BACKGROUND

Audio input/output devices, such as earbuds, headphones, cellular phones, and/or other devices having a microphone and loudspeaker, may be used to output audio using the loudspeaker and/or capture audio using the microphone. The audio device may be configured to communicate via a network connection with a user device, such as a smartphone, smartwatch, or similar device. A first audio device may similarly be configured to communicate with a second. The audio device may be used to output audio sent from the user device—the output audio may be, for example, music, voice, or other audio. The audio device may similarly be used to receive audio, which may include a representation of an utterance, and send corresponding data to the user device.

BRIEF DESCRIPTION OF DRAWINGS

For a more complete understanding of the present disclosure, reference is now made to the following description taken in conjunction with the accompanying drawings.

DETAILED DESCRIPTION

Figure 1:
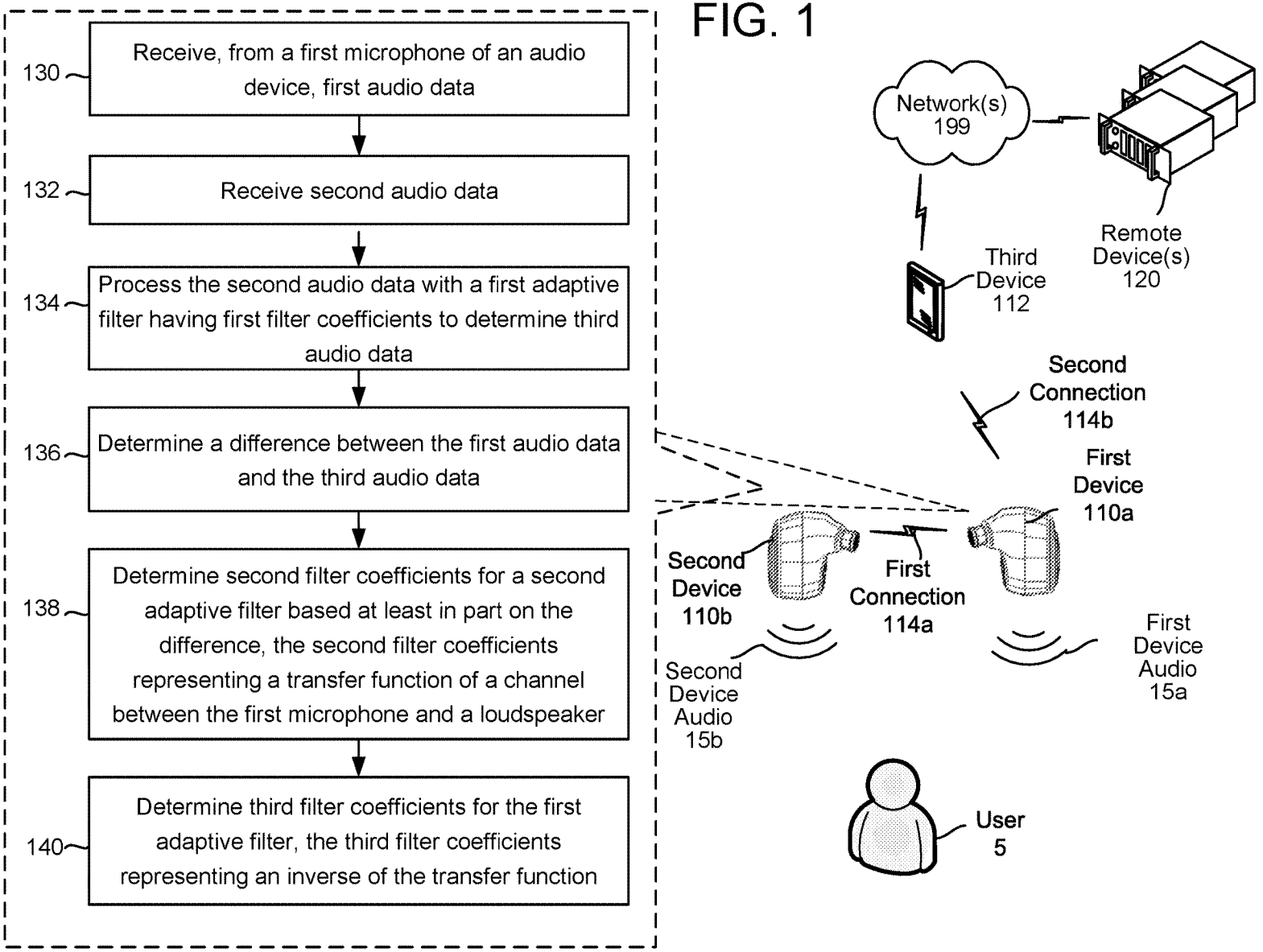
FIG. 1 illustrates a system configured to adaptively equalize output audio according to embodiments of the present disclosure.

Some electronic devices may include one or more microphones for capturing input audio and hardware and/or software for converting the input audio into audio data. The device may include an audio output device, such as a loudspeaker. Examples of such devices include in-ear audio devices, commonly referred to as "earbuds," headphones, and/or cellular phones. A user may interact with such a device partially or exclusively using his or her voice and ears. Exemplary interactions include listening to music, video, or other audio, communications such as telephone calls, audio messaging, and video messaging, and/or audio input for search queries, weather forecast requests, navigation requests, or other such interactions.

The audio device may be shaped or formed such that a surface of the device forms an acoustic barrier when it is in contact with an ear (or other body part) of a user. This barrier may, however, be imperfect; it may, for example, permit sound to penetrate it, especially low-frequency sounds (e.g., sound having frequencies less than approximately 1 kHz). This penetration may cause environmental noise, such as traffic noise, wind, or such noise, to reach the ear of the user. The penetration of the barrier may further negatively affect the device's ability to output audio; some portion of the output audio may escape or "leak" through the barrier, reducing the quality of the audio that reaches the ear of the user.

In various embodiments of the present disclosure, as explained in greater detail here, an adaptive filter of an automatic-echo cancellation system is adapted, using an algorithm such as a least-mean-squares ("LMS") algorithm to minimize an error signal that corresponds to a difference between microphone data and playback data. The result may be a transfer function, H(z), that processes audio data to remove the playback data. This same transfer function H(z) may then also be used by the equalizer to compensate for the effects of the barrier and/or effects caused by adaptive noise cancellation (ANC).

Acoustic echo cancellation "AEC") refers to systems and methods for removing audio output by a loudspeaker from a signal captured by a microphone. For example, if a first user is speaking to a second user via two devices over a network, the loudspeaker of the first user outputs the voice of the second user, and the microphone of the first user captures that voice. Without AEC, that voice would be send back to the device of the second user for re-output or ("echo"). Audio corresponding to the voice of the second user is thus subtracted from the data from the microphone. Before this subtraction, however, the voice of the second user may be delayed to account for the time-of-flight of the sound. The voice of the second user may also be modified in accordance with an estimation of the channel between the loudspeaker and microphone. As the term is used herein, "channel" refers to everything in the path between the loudspeaker (and associated circuitry) and the microphone (and associated circuitry), and may include a digital-to-analog converter (DAC) for transforming digital audio data into analog audio data, an amplifier and/or speaker driver for amplifying the analog audio data and for causing the loudspeaker to output audio corresponding to the amplified audio data, the physical space between the loudspeaker and the microphone (which may modify the audio sent therebetween based on the physical properties of the physical space, and/or an analog-to-digital converter for converting analog audio data received by the microphone into digital audio data.

Adaptive-noise cancellation ("ANC"), also referred to as active-noise control, refers to systems and methods for reducing unwanted ambient external sound or "noise" by producing a waveform, referred to herein as "anti-noise," having an opposite or negative amplitude—but similar absolute value—compared to the noise. For example, if a noise signal corresponds to sin Θ, the anti-noise signal corresponds to −sin Θ. The anti-noise is output such that it collides with the noise at a point of interest, such as a point at or near where an ear of a user is disposed, and cancels out some or all of the noise. The anti-noise may instead or in addition be combined with audio output or playback, such as audio output corresponding to music or voice, such that when the audio output collides with the noise, the noise is cancelled from the audio output.

Feedforward ANC ("FF-ANC") refers to a type of ANC in which a microphone of the device is positioned such that it receives audio from environmental sounds but not audio output by a microphone (e.g., an "external" microphone). This received audio may be delayed and inverted before being output by the loudspeaker (in addition to playback audio).

Feedback ANC ("FB-ANC) refers to a type of ANC in which a microphone of the device is positioned such that it receives both audio from environmental sounds and the audio output by a microphone (e.g., an "internal" microphone). Because this internal microphone captures the audio output, it processes the microphone data to remove the corresponding audio. For example, the FB-ANC may adapt an adaptable filter to remove noise audio only when the loudspeaker is not outputting its own audio. The FB-ANC may similarly process the microphone data to removing sounds having little variation (e.g., the drone of a ceiling fan) but not remove sounds having higher variation (e.g., voice and music).

In the present disclosure, audio devices that are capable of communication with both a third device and each other may be referred to as "earbuds," but the term "earbud" does not limit the present disclosure to any particular type of wired or wireless headphones and/or other audio device, such as a cellular phone. The present disclosure may further differentiate between a "right earbud," meaning a headphone component disposed in or near a right ear of a user, and a "left earbud," meaning a headphone component disposed in or near a left ear of a user. A "primary" earbud may communicate with both a "secondary" earbud, using a first wired or wireless connection (such as a cable, Bluetooth, or NFMI connection); the primary earbud may further communicate with a third device (such as a smartphone, smart watch, tablet, computer, server, or similar device) using a second wired or wireless connection (such as a cable, Bluetooth, or Wi-Fi connection). The secondary earbud may communicate directly with only with the primary earbud and may not communicate, using its own dedicated connection, directly with the third device; communication therewith may pass through the primary earbud via the first wired or wireless connection.

The primary and secondary earbuds may include similar hardware and software; in other instances, the secondary earbud includes different hardware/software included in the primary earbud. If the primary and secondary earbuds include similar hardware and software, they may trade the roles of primary and secondary prior to or during operation. In the present disclosure, the primary earbud may be referred to as the "first device," the secondary earbud may be referred to as the "second device," and the smartphone or other device may be referred to as the "third device." The first, second, and/or third devices may communicate over a network, such as the Internet, with one or more server devices, which may be referred to as "remote device(s)."

Each of the primary and secondary earbuds may also include a loudspeaker; the loudspeaker may include a single audio-output device or a plurality of audio-output devices. As the term is used herein, a loudspeaker refers to any audio-output device; in a system of multiple audio-output devices, however, the system as a whole may be referred to as a loudspeaker while the plurality of audio-output devices therein may each be referred to as a "driver." The driver may be a balanced-armature driver, dynamic driver, or any other type of driver.

A balanced-armature driver may include a coil of electric wire wrapped around an armature; the coil may be disposed between two magnets, and changes in the current in the coil may cause attraction and/or repulsion between it and the magnets, thereby creating sound using variations in the current. A balanced-armature driver may be referred to as "balanced" because there may be no net force on the armature when it is centered in the magnetic field generated by the magnets and when the current is not being varied.

A dynamic driver may include a diaphragm attached to a voice coil. When a current is applied to the voice coil, the voice coil moves between two magnets, thereby causing the diaphragm to move and produce sound. Dynamic drivers may thus be also known as "moving-coil drivers." Dynamic drivers may have a greater frequency range of output sound when compared to balanced-armature drivers but may be larger and/or more costly.

An earbud may be shaped or formed such that, when an inner-lobe insert of the earbud is inserted in an ear canal of a user, the inner-lobe insert and the ear canal wall form an acoustic barrier, thereby wholly or partially blocking external audio from the inner ear of the user. This form of noise cancellation may be referred to herein as passive noise cancellation, as distinguished from active noise cancellation systems and methods, such as ANC. The external audio may be, for example, utterances by the user or others, traffic noise, music, or television audio. ANC techniques may be used in addition to the acoustic barrier to further quiet external audio. Sometimes, however, a user of the earbuds may want to hear the external audio. For example, the user may wish to speak to another person while wearing earbuds or may wish to hear environmental noise while wearing earbuds. The earbuds, and in particular the acoustic barrier, may, however, render this external audio difficult, unpleasant, or impossible to listen to. For example, the acoustic barrier may filter out a high-frequency portion of the external audio such that only a low-frequency portion of the external audio reaches the ear of the user. The user may find it difficult to, for example, distinguish speech in this low-frequency portion of the external audio. Moreover, sounds generated inside the body of the user—such as vibrations from speech, chewing noises, etc.—may seem or be louder due to the acoustic barrier.

The present disclosure offers a system and method for adapting an equalizer to improve the quality of sound heard by the user. FIG. 1 illustrates a system for filtering audio in an in-ear audio device in accordance with embodiments of the present disclosure. A first device 110*a* and a second device 110*b* may communicate using a first wired or wireless connection 114*a*, which may be a cable, Bluetooth, NFMI, Wi-Fi, or other connection. The first device 110*a* may communicate with a third device 112—such as a smartphone, smart watch, or similar device—using a second wired or wireless connection 114*b*, which may also be a cable, Bluetooth, NFMI, Wi-Fi, or similar connection. Audio data may be sent, using the second wireless connection 114*b*, from the first device 110*a* to the third device 112 and/or from the third device 112 to the first device 110*a*. Audio data may be sent, using the first wireless connection 114 and the second wireless connection 114*b*, from the second device 110*b* to the third device via the first device 110*a* and/or from the third device 112 to the second device 110*b* via the first device 110*a*. In some embodiments, the second wireless connection 114*a* changes to connect the second device 110*b* and the third device 112. The present disclosure may refer to particular Bluetooth protocols, such as classic Bluetooth, Bluetooth Low Energy ("BLE" or "LE"), Bluetooth Basic Rate ("BR"), Bluetooth Enhanced Data Rate ("EDR"), synchronous connection-oriented ("SCO"), and/or enhanced SCO ("eSCO"), but the present disclosure is not limited to any particular Bluetooth or other protocol. In some embodiments, however, a first wireless connection 114*a* between the first device 110*a* and the second device 110*b* is a low-power connection such as BLE or NFMI; the second wireless connection 114*b* may include a high-bandwidth connection such as EDR in addition to or instead of a BLE connection. The third device 112 may communicate with one or more remote device(s) 120, which may be server devices, via a network 199, which may be the Internet, a wide-area network ("WAN") or local-area network ("LAN"), or any other network. The first device 110*a* may output first device audio 15*a*, and the second device 110*b* may output second device audio 15*b*. The first device 110*a* and second device 110*b* may capture input audio from a user 5, process the input audio, and/or send the input audio and/or processed input audio to the third device 112 and/or remote device(s) 120 for further processing and/or communication.

The device 110*a*/110*b* receives (130), from a first microphone, first audio data. As described herein, the device may include a microphone array and may perform other processing on the first audio input data, such as beamforming. The device 110*a*/110*b* receives (132) second audio data. This second audio data may be received from the third device 112, the remote device 120, a computer memory of the device 110*a*/110*b* itself, or from any other source. The device 110*a*/110*b* processes (134) the second audio data, with a first adaptive filter having first filter coefficients to determine third audio data. This first adaptive filter may be an adaptive equalizer, such as the adaptive equalizer 520 of FIG. 5, and may be a filter such as a finite-impulse response filter, an infinite impulse-response filter, a cascading biquad filter, a lattice-ladder filter, and/or any other type of filter, and may be a configured with filter coefficients that represent an inverse of a transfer function H(z), as explained in greater detail below. The filter coefficients may have been determined by a previous operation of an AEC component, such as the AEC audio filter 522, as also explained in greater detail below.

The device 110*a*/110*b* determines (136) a difference between the first audio data and the third audio data using, for example, an AEC filter controller 532, which may implement a least-mean-squares ("LMS") algorithm. Determining the difference may include filtering the first audio data using an AEC audio filter 522. Based on this processing, the AEC filter controller 532 determines (138) second filter coefficients for the AEC filter 522 based on the difference, the second filter coefficients representing a transfer function corresponding to an estimate of a channel between the first microphone and a loudspeaker. The AEC filter 522 may then send filter data 528 representing the updated filter coefficients. The device 110*a*/110*b* may then determine (140) third filter coefficients for the first adaptive filter, the third filter coefficients representing an inverse of the transfer function.

The AEC filter 522 may send the filter data 528 after each new determination of the updated filter coefficients. In other embodiments, the AEC filter 522 sends the filter data 528 only after an amount of change between last-sent and currently determined filter coefficients is greater than a threshold. The AEC filter 522, may determine a sum of the differences between each filter coefficient of the last-sent filter coefficients and each corresponding filter coefficient of the currently determined filter coefficients and send the currently determined filter coefficients if this sum is greater than a threshold. In other embodiments, the AEC filter 522 may send the currently determined filter coefficients if the difference between one coefficient of the currently determined filter coefficients and a corresponding coefficient of the last-sent filter coefficients is greater than a second threshold. In still other embodiments, the AEC filter 522 includes a library of a number of predetermined filter coefficients and sends a set of predetermined filter coefficients that most closely match the currently-determined filter coefficients. If first set of predetermined filter coefficients is in use, a second is selected only if a difference between at least one coefficient of the currently determined filter coefficients and a corresponding at least one of the first set of predetermined coefficients is greater than a first threshold and a difference between at least one of the currently determined filter coefficients and a corresponding one of the second is less than a second threshold.

The device 110*a*/110*b* may then use the third filter coefficients and the first adaptive filter to determine third output data, which may be output using the loudspeaker 202*a*/202*b*. In some embodiments, an ANC component 530 may be turned on to perform noise cancellation.

Figures 2A, 2B:
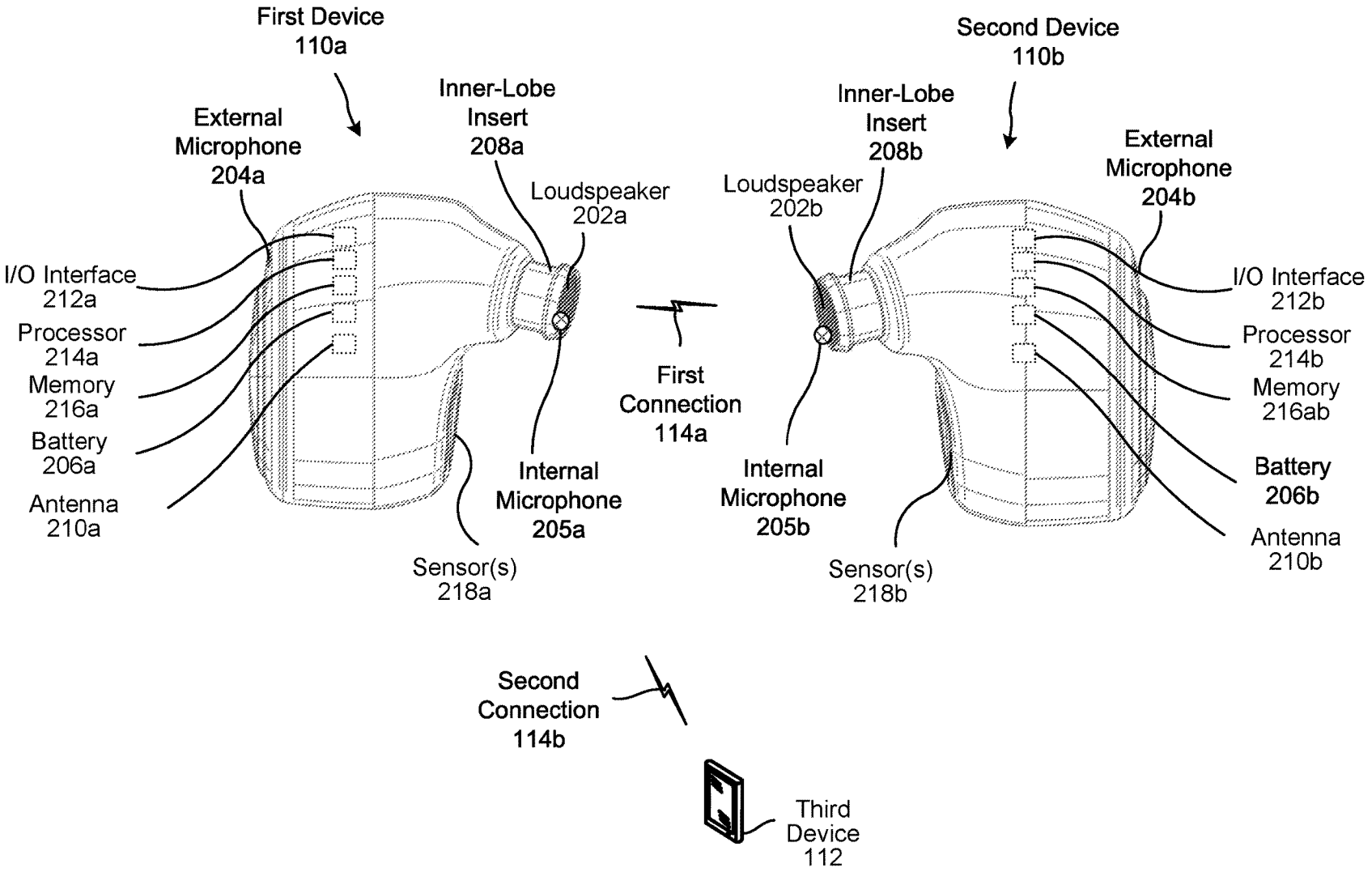
FIGS. 2A and 2B are diagrams of components of audio devices according to embodiments of the present disclosure.

FIGS. 2A and 2B illustrate additional features of an embodiment of the first device 110*a* and second device 110*b*, respectively. As shown, the first device 110*a* and second device 110*b* have similar features; in other embodiments, as noted above, the second device 110*b* (i.e., the secondary device) may have additional features with respect to the first device 110*a* or only a subset of the features of the first device 110*a*. As illustrated, the first device 110*a* and second device 110*b* are depicted as wireless earbuds having an inner-lobe insert; as mentioned above, however, the present disclosure is not limited to only wireless earbuds, and any wearable audio input/output system, such as a headset, over-the-ear headphones, or other such systems, is within the scope of the present disclosure.

The devices 110*a*/110*b* may each include a loudspeaker 202*a*/202*b*. The loudspeaker 202*a*/202*b* may be any type of loudspeaker, such as an electrodynamic loudspeaker, electrostatic loudspeaker, dynamic loudspeaker, diaphragm loudspeaker, or piezoelectric loudspeaker. The loudspeaker 202*a*/202*b* may further include one or more drivers, such as balanced-armature drivers. The present disclosure is not limited to any particular type of loudspeaker 202*a*/202*b* or driver.

The devices 110*a*/110*b* may further each include one or more microphones, such as external microphones 204*a*/204*b* and/or internal microphones 205*a*/205*b*. The microphones 204*a*/204*b* and 205*a*/205*b* may be any type of microphone, such as a piezoelectric or microelectromechanical system ("MEMS") microphone. The loudspeakers 202*a*/202*b* and microphones 204*a*/204*b* and 205*a*/205*b* may be mounted on, disposed on, or otherwise connected to the body of the devices 110*a*/110*b*. The devices 110*a*/110*b* may each further include inner-lobe inserts 208*a*/208*b* that may position the loudspeakers 202*a*/202*b* closer to the eardrum of the user and/or block ambient noise by forming an acoustic barrier with the ear canal of a user. The inner-lobe inserts 208*a*/208*b* may be made of or include a soft, spongy, or foam-like material that may be compressed before insertion into an ear of a user and that may expand once placed in the ear, thereby creating a seal between the inner-lobe inserts 208*a*/208*b* and the ear. The inner-lobe inserts 208*a*/208*b* may further include a passageway that permits air to pass from the inner-lobe insert 208*a*/208*b* to an external surface of the devices 110*a*/110*b*. This passageway may permit air to travel from the ear canal of the user to the external surface during insertion of the devices 110*a*/110*b*.

The internal microphones 205*a*/205*b* may be disposed in or on the inner-lobe inserts 208*a*208*b* or in or on the loudspeakers 202*a*/202*b*. The external microphones 204*a*/204*b* may be disposed on an external surface of the devices 110*a*/110*b* (i.e., a surface of the devices 110*a*/110*b* other than that of the inner-lobe inserts 208*a*/208*b*).

One or more batteries 206*a*/206*b* may be used to provide power to the devices 110*a*/110*b*. One or more antennas 210*a*/210*b* may be used to transmit and/or receive wireless signals over the first connection 114*a* and/or second connection 114*b*; an I/O interface 212*a*/212*b* contains software and hardware to control the antennas 210*a*/210*b* and transmit signals to and from other components. A processor 214*a*/214*b* may be used to execute instructions in a memory 216*a*/216*b*; the memory 216*a*/216*b* may include volatile memory (e.g., random-access memory) and/or non-volatile memory or storage (e.g., flash memory). One or more sensors 218*a*/218*b*, such as accelerometers, gyroscopes, or any other such sensor may be used to sense physical properties related to the devices 110*a*/110*b*, such as orientation; this orientation may be used to determine whether either or both of the devices 110*a*/110*b* are currently disposed in an ear of the user (i.e., the "in-ear" status of each device) or not disposed in the ear of the user (i.e., the "out-of-ear" status of each device).

Figure 3:
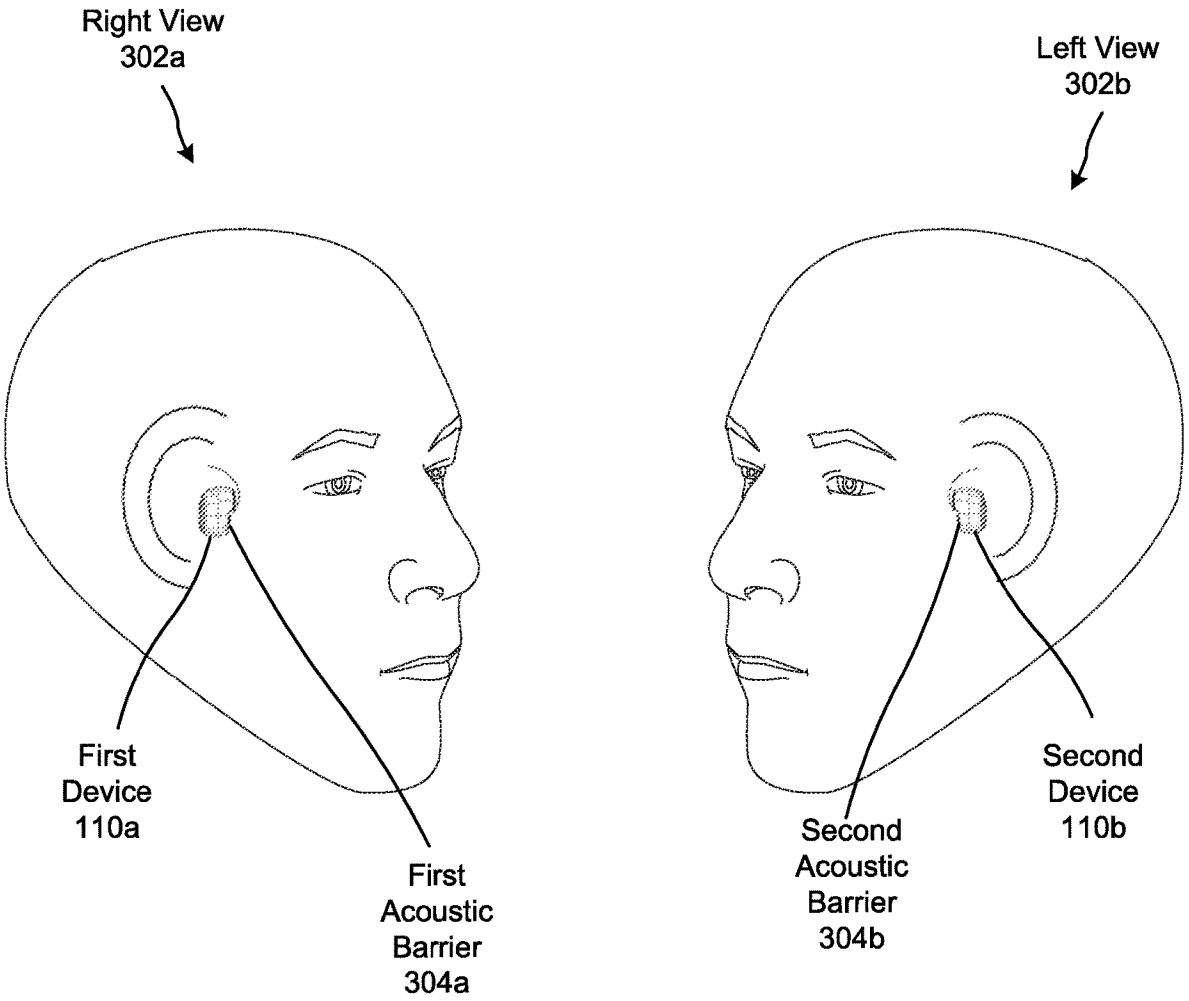
FIG. 3 is a conceptual diagram of audio devices in use according to embodiments of the present disclosure.

FIG. 3 illustrates a right view 302*a* and a left view 302*b* of a user of the first device 110*a* and the second device 110*b*. The first device 110*a* may be associated with a first acoustic barrier 304*a*, and the second device 110*b* may be associated with a second acoustic barrier 304*b*. The present disclosure is not, however, limited to only in-ear devices like earbuds and headphones and their associated acoustic barriers, and includes over-the-ear "clam shell" headphones. Even cellular phone held near the ear of the user may be associated with a partial acoustic barrier.

Figure 4:
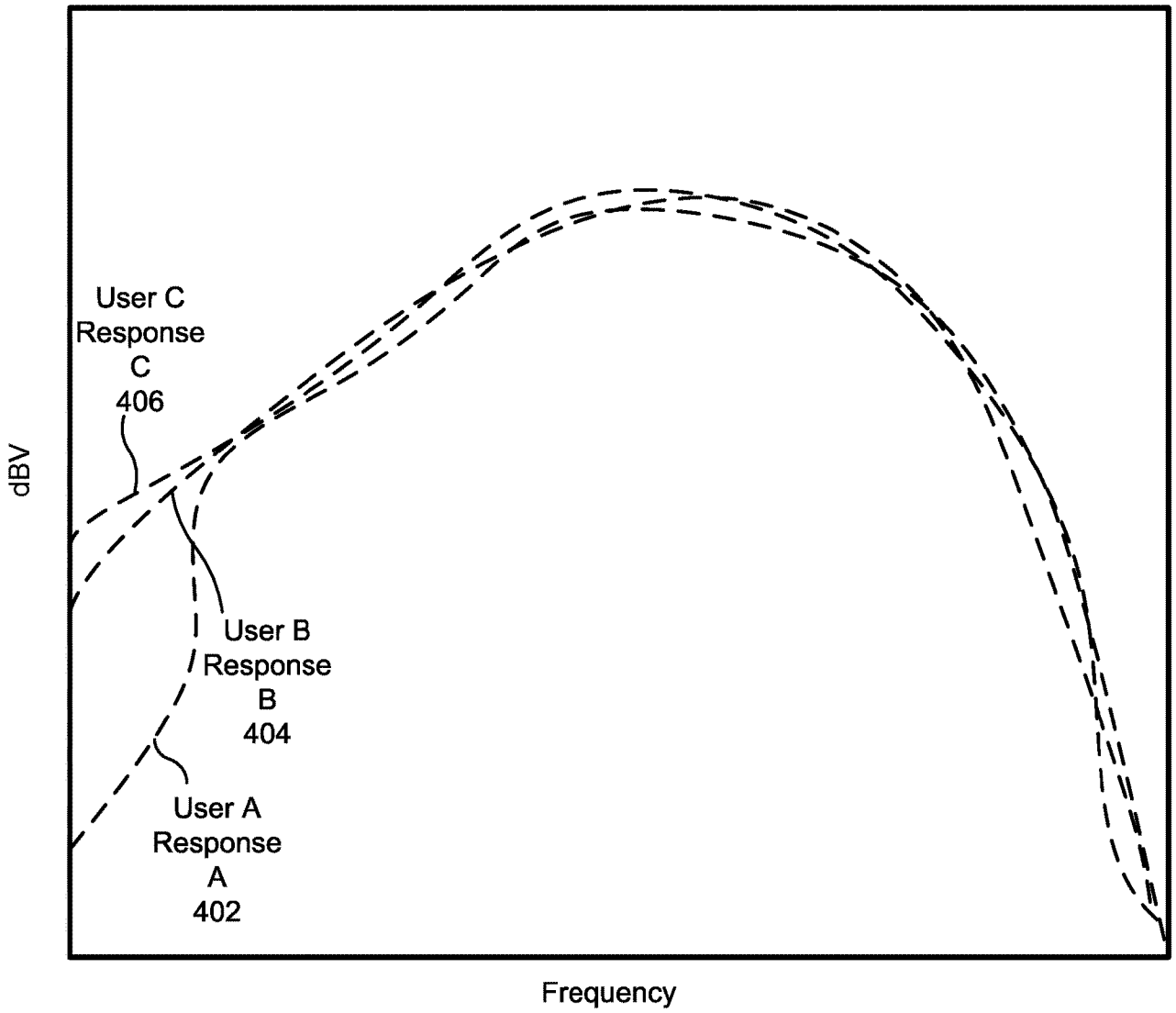
FIG. 4 is a diagram of frequency responses for different users according to embodiments of the present disclosure.

FIG. 4 illustrates exemplary frequency-response curves 402, 404, 406 for each of a first user A, a second user B, and a third user C, respectively. As shown, the frequency responses are worse at lower frequencies, such at frequencies below 1 kHz and especially at frequencies below 100 Hz. This poor low-frequency response may be caused by, as explained herein, the acoustic barrier allowing low frequencies to pass through.

Moreover, the frequency response curves 402, 404, 406 may vary from person to person due to the size and shape of the ears of the person, as well as the fit of the devices 110*a*/110*b* in the ears of the person. One person may have placed the devices 110*a*/110*b* more firmly in the ears than did a second, for example. Or, as another example, one person may have selected a better-fitting configurable rubber portion of the devices 110*a*/110*b* than did a second. In general, the better the acoustic barrier, the greater the frequency response (e.g., user C's response 406), and the worse the acoustic barrier, the less the frequency response (e.g., user A's response 402).

Variation in the frequency response curves 402, 404, 406 may further be caused by the ANC component 530. In some embodiments, the ANC component 530 causes distortion of loudspeaker audio 506, especially at low frequencies. As described herein, embodiments of the present disclosure may further reduce or eliminate this distortion.

Figure 5:
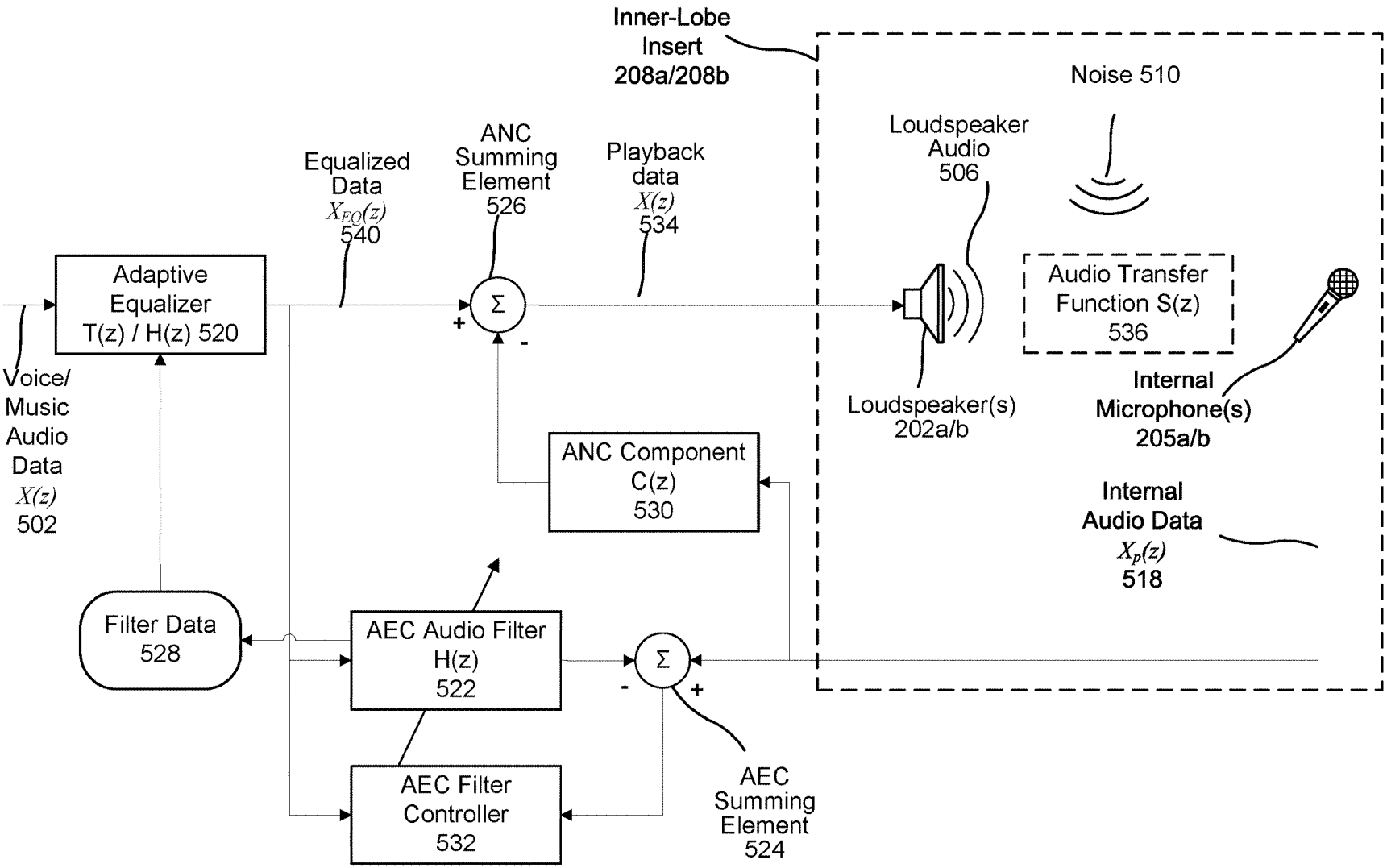
FIG. 5 is a block diagram of a system configured to adaptively equalize output audio according to embodiments of the present disclosure.

FIG. 5 illustrates a diagram of an adaptable equalizing system for use with the first and/or second devices 110*a*/110*b* according to embodiments of the present disclosure. The third device 112 may send, to the first and/or second device 110*a*/110*b*, audio data 502, which may be voice audio data, music audio data, or any other audio data. In other embodiments, the audio data 502 is generated by the first and/or second devices 110*a*/110*b* themselves. For example, the audio data 502 may be stored in a computer memory of the first and/or second devices 110*a*/110*b*

The first and/or second device 110*a*/110*b* may then output this audio data using a loudspeaker 202*a*/202*b*, which, as described above, may be a single loudspeaker or a system of drivers. The loudspeaker 202*a*/202*b* may be disposed on, in, or near the inner-lobe insert 208*a*/208*b* of the first and/or second device 110*a*/110*b*. The output of the loudspeaker 202*a*/202*b* may be referred to as loudspeaker audio 506 and may be received by the ear of a user, which may be proximate the microphones 205*a*/205*b*. For example, the eardrums of the user may be five millimeters or less from the corresponding microphones 205*a*/205*b*. That is, a right eardrum of the user may be less than five millimeters from a first microphone 205*a*, and a left eardrum of the user may be less than five millimeters from a second microphone 205*b*.

Before receiving the loudspeaker audio 506 at the microphones 205*a*/205*b*, the loudspeaker audio 506 may be modified by an audio transfer function S(z) 536. This transfer function represents an estimate of the effects that the channel between the loudspeakers 202*a*/202*b* and the microphones 205*a*/205*b* have on the audio output by the loudspeaker as it travels to the microphone. The effects may be caused by the physical size and shape of the channel, the physical properties of the ear canal walls of the user, and/or the physical properties of the inner-lobe insert 208*a*/208*b*. The effects may further vary based on environmental factors, such as air temperature and humidity. Other factors may include the electrical path that the loudspeaker audio travels, including such circuits as a digital-to-analog converter, loudspeaker driver, microphone driver, and/or analog-to-digital converter. As discussed herein, the audio transfer function S(z) 536 may vary based on how the inner-lobe insert 208*a*/208*b* forms the acoustic barrier (as illustrated by the variations in frequency-response curves 402, 404, 406 for different users).

As described above, noise 510 may be present in the inner-lobe insert 208*a*/208*b*. This noise may be affected by some or all of the audio transfer function S(z) 536 before being received by the microphone 205*a*/205*b*. An ANC component 530 may thus process the internal audio data 518 from the microphones 205*a*/205*b* in accordance with a transfer function C(z) to remove some or all of the noise 510. The ANC component 530 may determine times at which the loudspeaker 202*a*/202*b* is not output audio and configure an adaptive filter to reduce or eliminate the noise 510 during those times. When the loudspeaker 202*a*/202*b* is outputting audio 506, the may cease this configuration of the adaptive filter. The ANC component 530 may further configure the adaptive filter to remove only low-frequency noise, such as noise below 1000 Hz or 100 Hz. The microphone data 518, represented below in Equation (1) as $X_p(z)$, may thus have the below relationship with the output 534 of an ANC summing element 526, represented below as X(z).

$$X_p(z) = X(z)\frac{S(z)}{1 + C(z)S(z)} \tag{1}$$

As mentioned above, an AEC audio filter 522 may be configured to process audio data in accordance with a transfer function H(z), given below as Equation (2) which may represent the channel between the loudspeaker 202*a*/202*b* and the microphone 205*a*/205*b*.

$$H(z) = \frac{S(z)}{1 + C(z)S(z)} \tag{2}$$

The AEC audio filter 522 may be an adaptive filter, such as an FIR or IIR filter. The AEC audio filter 522 may apply a number of filter coefficients, or "weights" in a convolution operation to an input signal x(n) to generate an output signal y(n) in accordance with the below equation (3), in which $w_k(n)$ represents N coefficients at a specific time n.

$$y(n) = \sum_{k=0}^{N-1} w_k(n) \cdot x(n-k) \tag{3}$$

The AEC filter controller 532 may use an algorithm, such as an LMS algorithm, to adjust the coefficients to minimize a difference between the output of the adaptive equalizer 520 and the output of the AEC summing element 524.

In some embodiments, a user may wish to modify one or more qualities of the loudspeaker audio 506. The user may select, for example, from a set of predetermined target functions T(z) that each correspond to different equalizer profiles for playback, such as "rock 'n' roll," "bass boost," or "sports." The target function T(z) corresponding to "bass boost" may, for example, increase the volume of lower audio frequencies in the loudspeaker audio 506. The target function T(z) may describe, for each of a number of frequencies and/or frequency ranges, a corresponding amount to amplify or attenuate audio data that falls in that frequency. A target function T(z) intended to amplify low-frequency audio data (e.g., "bass boost") may, for example, indicate that frequencies of audio data falling between 20 Hz and 2 kHz should be amplified by 20%; frequencies of audio data falling between 2 kHz and 15 kHz should be unmodified; and frequencies of audio data falling between 15 kHz and 20 kHz should be attenuated by 20%. The internal audio data 518 may thus be modified in accordance with a selected target function T(z) to have a different equalizer profile in accordance with the below Equation (4).

$$X_p(z)=T(z)X(z) \tag{4}$$

The adaptive equalizer 520 may thus, in addition to processing the audio data 502 to apply the inverse of the transfer function H(z), may further be configured to process the audio data to apply a target function T(z) in accordance with the below Equation (5) to apply a modified transfer function APEQ(z).

$$APEQ(z) = \frac{T(z)}{H(z)} \tag{5}$$

The output 540 of the adaptive equalizer may then be given as shown in Equation 6.

$$X_{EQ}(Z)=APE\ Q(z)X(z) \tag{6}$$

One or both in-ear audio devices may use a particular target function T(z) when the user device sends data corresponding to that target function T(z) to one or both in-ear audio devices. In some embodiments, the user device sends the data to a primary in-ear audio device, which then sends that data (and/or corresponding data) to a secondary in-ear audio device. In other embodiments, two or more target functions T(z) are stored in a computer memory of the in-ear audio device; the user device may then send an indication of the target function T(z) to the in-ear audio device (e.g., "target function T(z) 1," and then the in-ear audio device may select data corresponding to the target function T(z) based on the indication.

In some embodiments, the ANC component 530 may, in some situations, be turned off or otherwise disabled (e.g., C(z)=0). The device 110*a*/110*b* may turn off the ANC component 530 if it determines that a level of cancellation of the loudspeaker audio 506 (in addition to cancellation of the noise audio 510) is too great. That is, in addition to generating an output that cancels the noise audio 510, the ANC component 530 may generate an output that cancels some or all of the loudspeaker audio 506. In some embodiments, the ANC component 530 determines whether its output contains a representation of the loudspeaker audio 506; if this representation corresponds to a volume greater than a threshold (e.g., the ANC component 530 is cancelling too much of the loudspeaker audio 506), the ANC component 530 may be disabled. If, on the other hand, the representation corresponds to a volume less that that threshold (or a second threshold), the ANC component may be enabled (and/or continue to be enabled). When the ANC component 530 enabled or disabled, however, the adaptive equalizer 520 may continue to process the audio data 502 to reduce or eliminate audio distortion caused by differences in the acoustic barrier, as shown in FIG. 4.

In some embodiments, a user may configure the device 110*a*/110*b* to receive audio data using an external microphone 204*a*/204*b*, process the audio data as described herein, and cause the loudspeaker 202*a*/202*b* to output audio corresponding to the audio data. A user may, for example, wish to hear environmental sounds, such as speech, without removing the devices 110*a*/110*b*.

Figure 6:
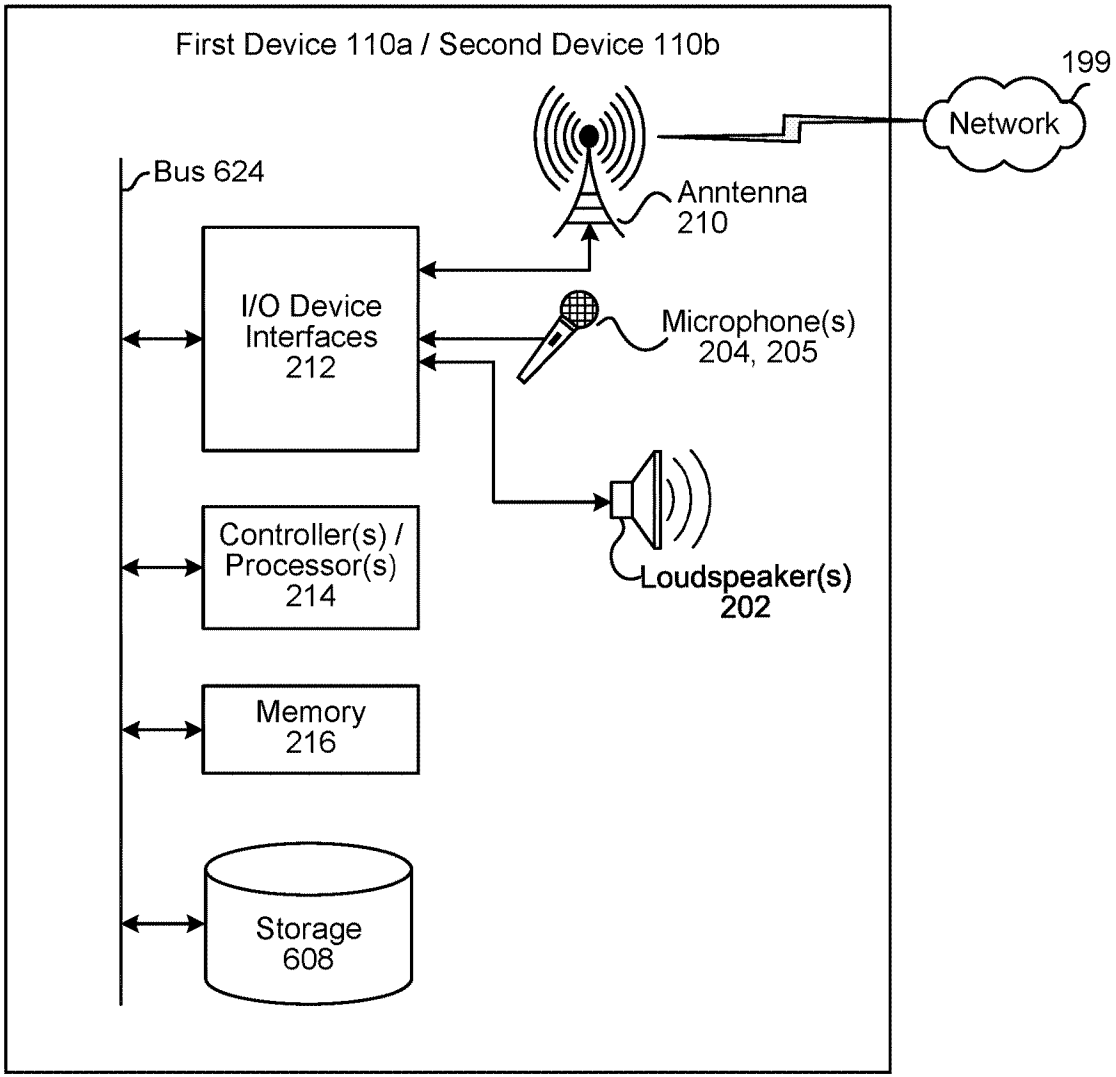
FIG. 6 is a block diagram illustrating example in-ear devices according to embodiments of the present disclosure.

FIG. 6 is a block diagram conceptually illustrating a first device 110*a* or second device 110*b* that may be used with the described system. Each of these devices 110*a*/110*b* may include one or more controllers/processors 214, which may each include a central processing unit (CPU) for processing data and computer-readable instructions and a memory 216 for storing data and instructions of the respective device. The memories 216 may individually include volatile random-access memory (RAM), non-volatile read-only memory (ROM), non-volatile magnetoresistive (MRAM) memory, and/or other types of memory. Each device may also include a data-storage component for storing data and controller/processor-executable instructions. Each data-storage component may individually include one or more non-volatile storage types such as magnetic storage, optical storage, solid-state storage, etc. Each device may also be connected to removable or external non-volatile memory and/or storage (such as a removable memory card, memory key drive, networked storage, etc.) through respective input/output device interfaces.

Computer instructions for operating each device 110*a*/110*b* and its various components may be executed by the respective device's controller(s)/processor(s) 214, using the memory 216 as temporary "working" storage at runtime. A device's computer instructions may be stored in a non-transitory manner in non-volatile memory 216, storage 608, or an external device(s). Alternatively, some or all of the executable instructions may be embedded in hardware or firmware on the respective device in addition to or instead of software.

Each device 110*a*/110*b* includes input/output device interfaces 212. A variety of components may be connected through the input/output device interfaces, as will be discussed further below. Additionally, each device 110*a*/110*b* may include an address/data bus 624 for conveying data among components of the respective device. Each component within a device 110*a*/110*b* may also be directly connected to other components in addition to (or instead of) being connected to other components across the bus 624.

For example, via the antenna 210, the input/output device interfaces 212 may connect to one or more networks 199 via a wireless local area network (WLAN) (such as Wi-Fi) radio, Bluetooth, and/or wireless network radio, such as a radio capable of communication with a wireless communication network such as a Long Term Evolution (LTE) network, WiMAX network, 3G network, etc. A wired connection such as Ethernet may also be supported. Through the network(s) 199, the speech processing system may be distributed across a networked environment.

Figure 7:
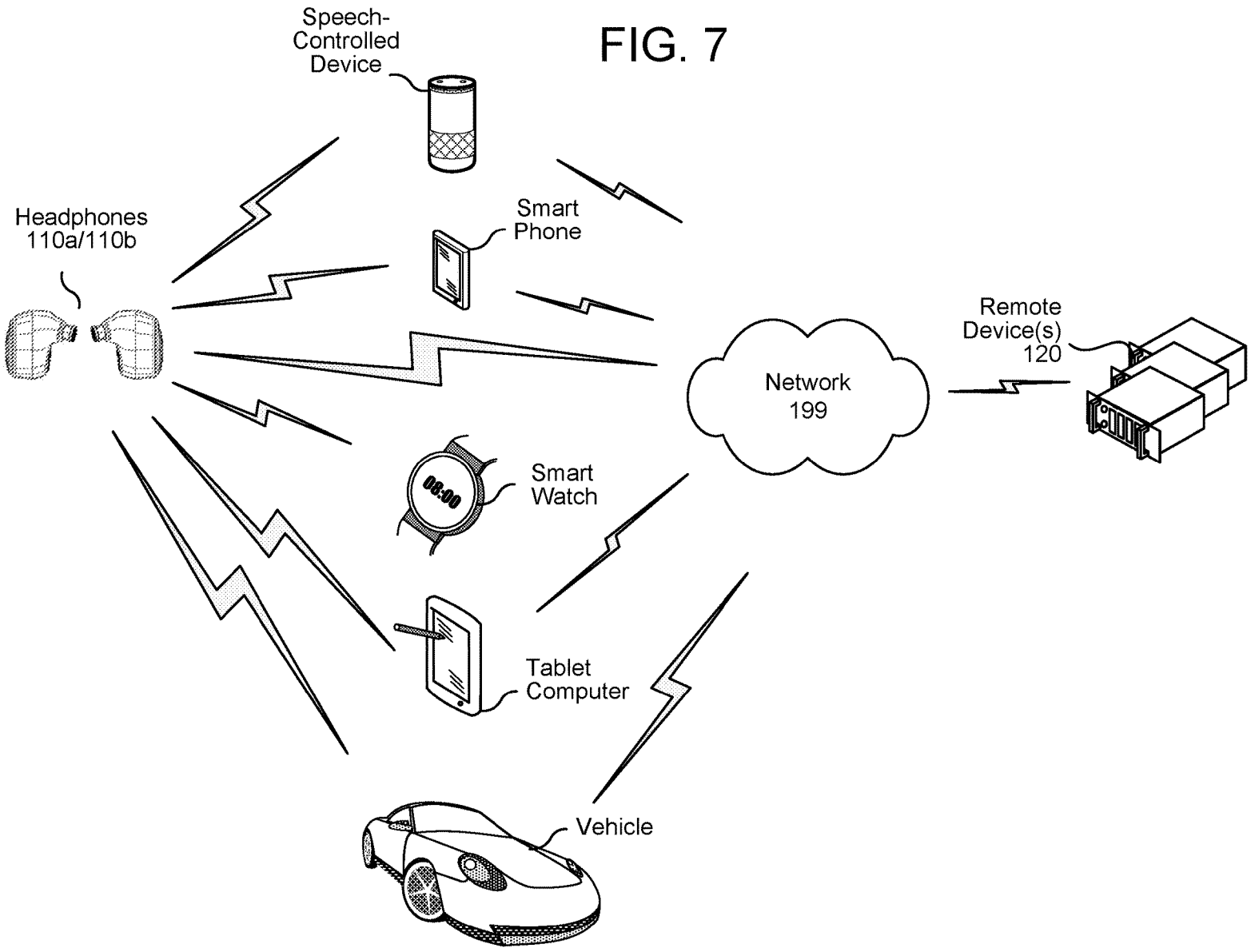
FIG. 7 illustrates an example of a computer network for use with audio-filtering devices.

As illustrated in FIG. 7, multiple devices may contain components of the system 100 and the devices may be connected over a network 199. The network 199 may include one or more local-area or private networks and/or a wide-area network, such as the internet. Local devices may be connected to the network 199 through either wired or wireless connections. For example, a speech-controlled device, a tablet computer, a smart phone, a smart watch, and/or a vehicle may be connected to the network 199. One or more remote device(s) 120 may be connected to the network 199 and may communicate with the other devices therethrough. Headphones 110*a*/110*b* may similarly be connected to the remote device(s) 120 either directly or via a network connection to one or more of the local devices.

The above aspects of the present disclosure are meant to be illustrative and were chosen to explain the principles and application of the disclosure; they are not intended to be exhaustive or to limit the disclosure. Many modifications and variations of the disclosed aspects may be apparent to those of skill in the art. Persons having ordinary skill in the field of computers, wearable devices, and speech processing will recognize that components and process steps described herein may be interchangeable with other components or steps, or combinations thereof, and still achieve the benefits and advantages of the present disclosure. Moreover, it will be apparent to one skilled in the art that the disclosure may be practiced without some or all of the specific details and steps disclosed herein. As the term is used herein, "component" may be interchanged with similar terms, such as "module" or "engine."

Aspects of the disclosed system may be implemented as a computer method or as an article of manufacture, such as a memory device or non-transitory computer readable storage medium. The computer-readable storage medium may be readable by a computer and may comprise instructions for causing a computer or other device to perform processes described in the present disclosure. The computer-readable storage medium may be implemented by a volatile computer memory, non-volatile computer memory, hard drive, solid-state memory, flash drive, removable disk, and/or other media. In addition, components of system may be implemented in firmware and/or hardware, such as an acoustic front end (AFE), which comprises, among other things, analog and/or digital filters (e.g., filters configured as firmware to a digital signal processor (DSP)).

Conditional language used herein, such as, "can," "could," "might," "may," "e.g.," and the like, unless specifically stated otherwise, or otherwise understood within the context as used, is generally intended to convey that certain embodiments include, while other embodiments do not include, certain features, elements and/or steps. Thus, such conditional language is not generally intended to imply that features, elements, and/or steps are in any way required for one or more embodiments or that one or more embodiments necessarily include logic for deciding, with or without other input or prompting, whether these features, elements, and/or steps are included or are to be performed in any particular embodiment. The terms "comprising," "including," "having," and the like are synonymous and are used inclusively, in an open-ended fashion, and do not exclude additional elements, features, acts, operations, and so forth. Also, the term "or" is used in its inclusive sense (and not in its exclusive sense) so that when used, for example, to connect a list of elements, the term "or" means one, some, or all of the elements in the list.

Disjunctive language such as the phrase "at least one of X, Y, Z," unless specifically stated otherwise, is understood with the context as used in general to present that an item, term, etc., may be either X, Y, or Z, or any combination thereof (e.g., X, Y, and/or Z). Thus, such disjunctive language is not generally intended to, and should not, imply that certain embodiments require at least one of X, at least one of Y, or at least one of Z to each be present. As used in this disclosure, the term "a" or "one" may include one or more items unless specifically stated otherwise. Further, the phrase "based on" is intended to mean "based at least in part on" unless specifically stated otherwise.

What is claimed is:

1. A method for compensating, using a wireless earbud having an inner-lobe insert, for audio distortion within an ear canal of a user, the method comprising:

during a first time period, receiving, at the wireless earbud from a user device, first output audio data;

processing, using an infinite-impulse-response (IIR) filter and first filter coefficients, the first output audio data to determine first modified output audio data, the first filter coefficients corresponding to an inverse of a first transfer function representing a first estimate of effects caused by a physical space disposed between a loudspeaker disposed on the inner-lobe insert and an internal microphone disposed on the inner-lobe insert; and outputting, using the loudspeaker, first modified audio corresponding to the first modified output audio data;

during a second time period after the first time period, receiving, from the internal microphone, first input audio data including a representation of the first modified output audio data as modified by the first transfer function;

determining, using a least-mean-squares (LMS) algorithm, the first input audio data, and the first modified output audio data, second filter coefficients corresponding to a second transfer function representing a second estimate of the physical space;

determining third filter coefficients corresponding to an inverse of the second transfer function;

receiving, at the wireless earbud from the user device, second output audio data; and processing, using the IIR filter and the third filter coefficients, the second output audio data to determine second modified output audio data.

2. The method of claim 1, further comprising:

receiving, from the user device, an indication of a target function representing an equalizer profile;

receiving, from the user device, third output audio data;

determining fourth filter coefficients by multiplying the target function with the inverse of the second transfer function; and processing, using the IIR filter and the fourth filter coefficients, the third output audio data to determine third modified output audio data.

3. A computer-implemented method, the method comprising:

receiving, by an audio device from a first microphone of the audio device, first audio data;

receiving, by the audio device from a user device, second audio data;

processing, by the audio device, the second audio data with a first adaptive filter having first filter coefficients to determine third audio data;

determining, by the audio device, a difference between the first audio data and the third audio data;

determining, by the audio device, second filter coefficients based at least in part on the difference, the second filter coefficients representing a transfer function of a channel between a loudspeaker of the audio device and the first microphone; and determining, by the audio device, based at least in part on the second filter coefficients, third filter coefficients for the first adaptive filter, the third filter coefficients representing an inverse of the transfer function.

4. The computer-implemented method of claim 3, further comprising:

determining, by the audio device, that a difference between a first filter coefficient of the third filter coefficients and a second filter coefficient of the first filter coefficients is greater than a threshold; and sending, to the first adaptive filter, the third filter coefficients.

5. The computer-implemented method of claim 3, further comprising:

determining, by the audio device, that a first difference between a first filter coefficient of the third filter coefficients and a second filter coefficient of the first filter coefficients is greater than a first threshold;

determining, by the audio device, that a second difference between the first filter coefficient of the third filter coefficients and a third filter coefficient of predetermined filter coefficients is less than a second threshold; and sending, to the first adaptive filter, the predetermined filter coefficients.

6. The computer-implemented method of claim 3, further comprising:

processing, by the audio device, fourth audio data with the first adaptive filter and the third filter coefficients to determine third audio output data; and causing output of the third audio output data.

7. The computer-implemented method of claim 6, wherein the first adaptive filter is an infinite-impulse response filter and processing the third audio data further comprises:

performing a convolution operation on the third audio data using the third filter coefficients.

8. The computer-implemented method of claim 3, further comprising:

after determining the third filter coefficients, receiving, from the first microphone, fourth audio data that includes a representation of noise and of playback audio;

processing, using a third adaptive filter, the fourth audio data to determine noise cancellation data, the noise cancellation data including a representation of the noise;

generating fifth audio data by subtracting the noise cancellation data from the fourth audio data; and causing output of the fifth audio data.

9. The computer-implemented method of claim 8, further comprising:

prior to generating the fifth audio data, determining, by the audio device, that the noise cancellation data includes a second representation of the playback audio; and determining, by the audio device, that a volume of audio corresponding to the second representation is less than a threshold for disabling noise cancellation.

10. The computer-implemented method of claim 3, wherein determining the difference further comprises:

processing, using a second adaptive filter and the second filter coefficients, the third audio data to determine fourth audio data;

receiving, from the first microphone, fifth audio data; and subtracting, by the audio device, the fifth audio data from the fourth audio data to determine sixth audio data.

11. The computer-implemented method of claim 3, wherein the first microphone is disposed on an inner-ear insert of the audio device, the method further comprising:

receiving, from a second microphone disposed on an external surface of the audio device, fourth audio data.

12. A system comprising:

at least one processor; and at least one memory including instructions that, when executed by the at least one processor, cause the system to:

receive, from a first microphone of an audio device, first audio data;

receive, from a user device, second audio data;

process second audio data with a first adaptive filter having first filter coefficients to determine third audio data;

determine a difference between the first audio data and the third audio data;

determine second filter coefficients based at least in part on the difference, the second filter coefficients representing a transfer function of a channel between a loudspeaker and the first microphone; and determine, based at least in part on the second filter coefficients, third filter coefficients for the first adaptive filter, the third filter coefficients representing an inverse of the transfer function.

13. The system of claim 12, wherein the at least one memory includes further instructions that, when executed by the at least one processor, cause the system to:

determine that a difference between a first filter coefficient of the third filter coefficients and a second filter coefficient of the first filter coefficients is greater than a threshold; and send, to the first adaptive filter, the third filter coefficients.

14. The system of claim 12, wherein the at least one memory includes further instructions that, when executed by the at least one processor, cause the system to:

determine that a first difference between a first filter coefficient of the third filter coefficients and a second filter coefficient of the first filter coefficients is greater than a first threshold;

determine that a second difference between the first filter coefficient of the third filter coefficients and a third filter coefficient of predetermined filter coefficients is less than a second threshold; and sending, to the first adaptive filter, the predetermined filter coefficients.

15. The system of claim 12, wherein the at least one memory includes further instructions that, when executed by the at least one processor, cause the system to:

process fourth audio data with the first adaptive filter and the third filter coefficients to determine third audio output data; and cause output of the third audio output data.

16. The system of claim 15, wherein the first adaptive filter is an infinite-impulse response filter and wherein the at least one memory includes further instructions that process the third audio data, and that, when executed by the at least one processor, cause the system to:

perform a convolution operation on the third audio data using the third filter coefficients.

17. The system of claim 12, wherein the at least one memory includes further instructions that, when executed by the at least one processor, cause the system to:

after determination of the third filter coefficients, receive, from the first microphone, fourth audio data that includes a representation of noise and of playback audio;

process, using a third adaptive filter, the fourth audio data to determine noise cancellation data, the noise cancellation data including a representation of the noise;

generate fifth audio data by subtracting the noise cancellation data from the fourth audio data; and cause output of the fifth audio data.

18. The system of claim 17, wherein the at least one memory includes further instructions that, when executed by the at least one processor, cause the system to:

prior to executing the instructions that generate the fifth audio data, determine that the noise cancellation data includes a second representation of the playback audio; and determine that a volume of audio corresponding to the second representation is less than a threshold for disabling noise cancellation.

19. The system of claim 12, wherein the at least one memory includes further instructions that, when executed by the at least one processor, cause the system to:

process, using a second adaptive filter and the second filter coefficients, the third audio data to determine fourth audio data;

receive, from the first microphone, fifth audio data; and subtract, by the audio device, the fifth audio data from the fourth audio data to determine sixth audio data.

20. The system of claim 12, wherein the at least one memory includes further instructions that, when executed by the at least one processor, cause the system to:

receive, from a second microphone disposed on an external surface of the audio device, fourth audio data.

* * * * *